US011551523B2

(12) United States Patent
Vasquez et al.

(10) Patent No.: US 11,551,523 B2
(45) Date of Patent: Jan. 10, 2023

(54) DIGITALLY ALTERING REDEEMED WAGERING TICKETS, AND RELATED SYSTEMS, METHODS, AND DEVICES

(71) Applicant: IGT, Las Vegas, NV (US)

(72) Inventors: James Vasquez, Carson City, NV (US); Dwayne Nelson, Las Vegas, NV (US)

(73) Assignee: IGT, Las Vegas, NV (US)

( * ) Notice: Subject to any disclaimer, the term of this patent is extended or adjusted under 35 U.S.C. 154(b) by 111 days.

(21) Appl. No.: 16/582,050

(22) Filed: Sep. 25, 2019

(65) Prior Publication Data

US 2021/0090393 A1 Mar. 25, 2021

(51) Int. Cl.
*G07F 17/32* (2006.01)

(52) U.S. Cl.
CPC ..... *G07F 17/3251* (2013.01); *G07F 17/3288* (2013.01)

(58) Field of Classification Search
CPC ..... G07F 17/3251; G07F 17/3288; G07F 17/3241; G07F 17/3244
See application file for complete search history.

(56) References Cited

U.S. PATENT DOCUMENTS 5,173,596 A * 12/1992 Kapinos ..... G06K 13/05 235/456
2003/0050806 A1* 3/2003 Friesen ..... G07F 17/3239 705/5
2006/0205482 A1* 9/2006 Crivelli ..... G07F 17/32 463/25
2006/0258439 A1* 11/2006 White ..... G07F 17/32 463/25
2011/0119098 A1* 5/2011 Miller ..... G07B 15/00 705/5
2013/0013389 A1* 1/2013 Vitti ..... G06Q 30/0207 705/14.35

OTHER PUBLICATIONS

GeWeTe—Cash Handling Technology; Cash-Center-Compact-Casino; Mar. 20, 2017 https://www.youtube.com/watch?v=4FD9GIEKP1k (Year: 2017).*

(Continued)

*Primary Examiner* — Jasson H Yoo
(74) *Attorney, Agent, or Firm* — Sage Patent Group

(57) ABSTRACT

Systems, devices, and methods for digitally altering redeemed wagering tickets include a processor circuit for performing operations. A memory coupled to the processor circuit includes machine-readable instructions that, when executed by the processor circuit, cause the processor circuit to receive an indication that a player has inserted a wagering ticket into an acceptor of a gaming device and cause an image capture device to generate a digital image of the wagering ticket. The processor digitally alters the digital image of the wagering ticket to form a digitally altered digital image. The digitally altered digital image includes a paid indication indicative that the wagering ticket has been redeemed, an amount indication indicative of an amount paid for the wagering ticket, and a time indication indicative of a time period associated with redemption of the wagering ticket.

19 Claims, 12 Drawing Sheets

(56) References Cited

OTHER PUBLICATIONS

News Room Details, "IGT to Unveil Expanded Scope of New Product Offerings at NIGA 2019," IGT, Mar. 25, 2019, downloaded from the internet (downloaded on Sep. 25, 2019) URL: <https://www.igt.com/Explore-IGT/News/News-Room-DetailsIndex=201903251373>6 pages.

Fuzion Technology, © 2019, JCM Global, downloaded from the internet (downloaded on Sep. 25, 2019) URL: <https://emea-en.icmglobal.com/product/fuzion/> 2 pages.

* cited by examiner

500

544

DIGITALLY ALTERING REDEEMED WAGERING TICKETS, AND RELATED SYSTEMS, METHODS, AND DEVICES

BACKGROUND

Embodiments relate to redeeming tickets for wagering games, and in particular to digitally altering redeemed wagering tickets, and related systems, methods, and devices. Redeemable tickets for wagering games are employed in a wide variety of applications, including within casinos or other betting establishments, such as at a sports and racing book, or in connection with gaming devices, such as electronic gaming machines (EGMs). Casinos and other betting establishments typically have high levels of regulation and reporting requirements. For example, some jurisdictions require that some winning wagering tickets, such as a sports wagering ticket or voucher, must be marked with specific information to indicate that the wagering ticket has been paid. However, as the volume of wagering tickets increases, the complexity and difficulty of managing and organizing the large volume of paper tickets also increases.

SUMMARY

According to an embodiment, a system for redeeming sports wagering tickets includes a processor circuit and a memory coupled to the processor circuit. The memory includes machine-readable instructions that, when executed by the processor circuit, cause the processor circuit to receive an indication that a player has inserted a wagering ticket into an acceptor of a gaming device, and cause an image capture device to generate a digital image of the wagering ticket. The machine-readable instructions further cause the processor circuit to digitally alter the digital image of the wagering ticket to form a digitally altered digital image including: a paid indication indicative that the wagering ticket has been redeemed, an amount indication indicative of an amount paid for the wagering ticket, and a time indication indicative of a time period associated with redemption of the wagering ticket.

According to another embodiment, a method includes receiving, by a processor circuit, an indication that a player has inserted a wagering ticket into an acceptor of a gaming device. The method further includes generating, by an image capture device of the gaming device, a digital image of the wagering ticket. The method further includes generating a digitally altered digital image of the wagering ticket including the digital image of the wagering ticket, a paid indication indicative that the wagering ticket has been redeemed, an amount indication indicative of an amount paid for the wagering ticket, and a time indication indicative of a time period associated with redemption of the wagering ticket. The method further includes storing the digitally altered digital image of the wagering ticket in a memory.

According to another embodiment, a system includes an image host device comprising an acceptor, the acceptor comprising a ticket scanning device and an image capture device. The system further includes a gaming device manager device in communication with the image host device. The system further includes a sports wagering system device in communication with the gaming device manager device. The system further includes a first communication link between the gaming device manager device and the image host device, and a second communication link between the sports wagering system device and the gaming device manager device. The system further includes a processor circuit and a memory coupled to the processor circuit. The memory includes machine-readable instructions that, when executed by the processor circuit, cause the processor circuit to receive an indication that a player has inserted a wagering ticket into the acceptor of a gaming device, and cause the image capture device to generate a digital image of the wagering ticket. The machine-readable instructions further cause the processor circuit to cause the image host device to receive the digital image of the wagering ticket from the image capture device via the first communication link. The machine-readable instructions further cause the processor circuit to cause the image host device to transmit the digital image to the gaming device manager device via the first communication link. The machine-readable instructions further cause the processor circuit to cause the gaming device manager device to digitally alter the digital image of the wagering ticket to form a digitally altered digital image including a paid indication indicative that the wagering ticket has been redeemed, an amount indication indicative of an amount paid for the wagering ticket, and a time indication indicative of a time period associated with redemption of the wagering ticket.

DETAILED DESCRIPTION

Embodiments relate to redeeming tickets for wagering games, and in particular to digitally altering redeemed wagering tickets, and related systems, methods, and devices. Many jurisdictions require that winning wagering tickets be marked with specific information. For example, internal controls for the state of Nevada require that, after scanning by the writer/cashier, the race and sports computer system brands the ticket/voucher with a paid designation, the amount of payment and date. Alternatively, if a writer/cashier manually enters or scans the ticket/voucher number into the race and sports computer system, the writer/cashier either immediately writes/stamps the date, amount of payment and a paid designation on the patron's ticket/voucher or attaches to the patron's copy a computer system "paid"

ticket which indicates a paid designation, the ticket/voucher number, the amount of payment and date.

Embodiments disclosed herein meet these and other regulatory requirements by generating and storing images and/or data containing the information that may be required, which can then be searched, retrieved, and/or printed on demand. Other advantages include the ability to provide centralized access to images and data for redeemed wagering tickets without the need to access the physical gaming tickets, e.g., by opening the gaming device's secure cash/ticket box. A searchable database may provide more efficient locating of paid wagering tickets, which will increase efficiency of play dispute resolutions and auditing processes. By securely storing the physical wagering tickets, security is increased over conventional methods of manually handling the physical tickets by casino personnel (e.g., sports ticket writers at a sports counter), while still permitting access to the tickets using drop box processes. As a result, these and other features provide a unique technical solution to the technical problem of efficiently managing redeemed wagering tickets.

Figure 1:
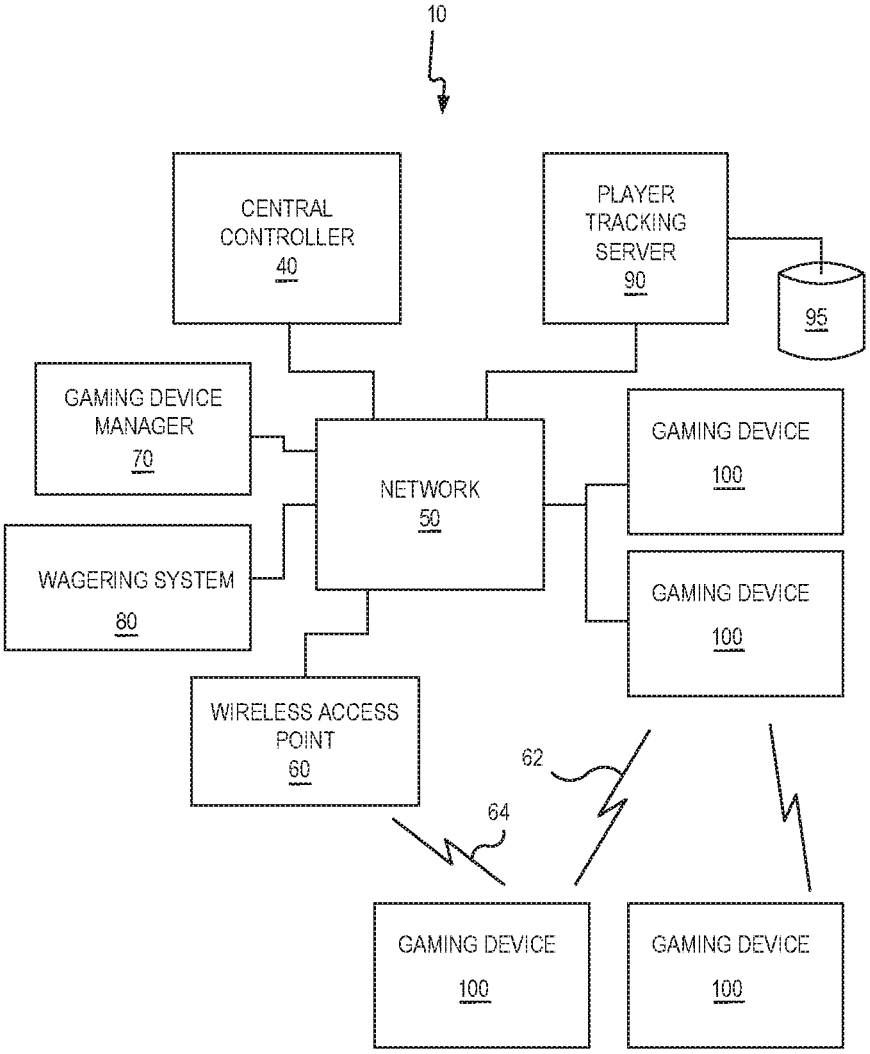
FIG. 1 is a schematic block diagram illustrating a network configuration for a plurality of gaming devices according to some embodiments.

Before discussing aspects of the embodiments disclosed herein, reference is made to FIG. 1, which illustrates a networked gaming system 10 that includes a plurality of gaming devices 100. The system 10 may be located, for example, on the premises of a gaming establishment, such as a casino. The gaming devices 100, which may be situated in a casino sports and racing book or elsewhere on a casino floor, may be in communication with each other and/or a central controller 40 through a data network 50 (or remote communication link). The data communication network 50 may be a private data communication network that is operated, for example, by the gaming facility that operates the gaming devices 100. Communications over the data communication network 50 may be encrypted for security. The central controller 40 may be any suitable server or computing device which includes a processor circuit and a memory or storage device. Each gaming device 100 may include a processor circuit that transmits and receives events, messages, commands or any other suitable data or signal between the gaming devices 100 and the central controller 40. The processor circuit is operable to execute such communicated events, messages or commands in conjunction with the operation of the gaming device 100. In some examples, the gaming device 100 may be a standalone device, such as an electronic gaming machine (EGM) (e.g., slot or video poker machine), sports betting terminal, or other gaming device, or may be part of another device, such as a computing device or mobile device with gaming functionality. Moreover, the processor circuit of the central controller 40 is configured to transmit and receive events, messages, commands or any other suitable data or signal between the central controller 40 and each of the individual gaming devices 100. In some embodiments, one or more of the functions of the central controller 40 may be performed by one or more processor circuits of the gaming device(s) 100. Moreover, in some embodiments, one or more of the functions of one or more processor circuits of the gaming devices 100 as disclosed herein may be performed by the central controller 40.

A wireless access point 60 provides wireless access to the data communication network 50. The wireless access point 60 may be connected to the data communication network 50 as illustrated in FIG. 1, or may be connected directly to the central controller 40 or another server connected to the data communication network 50. For example, in some embodiments, the gaming device 100 may communicate directly with the central controller 40 over a wireless interface 62, which may be a Wi-Fi link, a Bluetooth link, a Near-Field Communication (NFC) link, etc. In other embodiments, the gaming device 100 may communicate with the data communication network 50 (and devices connected thereto, including displays) over a wireless interface 64 with the wireless access point 60. The wireless interface 64 may include a Wi-Fi link, a Bluetooth link, an NFC link, etc. In still further embodiments, the gaming device 100 may communicate simultaneously with both the gaming device 100 over the wireless interface 62 and the wireless access point 60 over the wireless interface 64. In these embodiments, the wireless interface 62 and the wireless interface 64 may use different communication protocols and/or different communication resources, such as different frequencies, time slots, spreading codes, etc. For example, in some embodiments, the wireless interface 62 may be a Bluetooth link, while the wireless interface 64 may be a Wi-Fi link.

A gaming device manager 70 may also be connected through the data communication network 50. The gaming device manager 70 may control operation and provide certain functionality in connection with one or more gaming devices 100 in the network. Such functionality may include capturing, altering, and storing images of wagering tickets for later display, retrieval, searching, printing, etc. A wagering system 80, such as a sports wagering system for example, may also be integrated into the system 10, for controlling operation and providing functionality in connection with of one or more gaming devices 100 in the network. Such functionality may include resolving wagers and validating and redeeming associated wagering tickets, managing sports odds, sporting events, issuing sports tickets, and/or validating sports tickets and vouchers, for example.

A player tracking server 90 may also be connected through the data communication network 50. The player tracking server 90 may manage a player tracking account that tracks the player's gameplay and spending and/or other player preferences and customizations, manages loyalty awards for the player, manages funds deposited or advanced on behalf of the player, and other functions. Player information managed by the player tracking server 90 may be stored in a player information database 95.

Figure 2A:
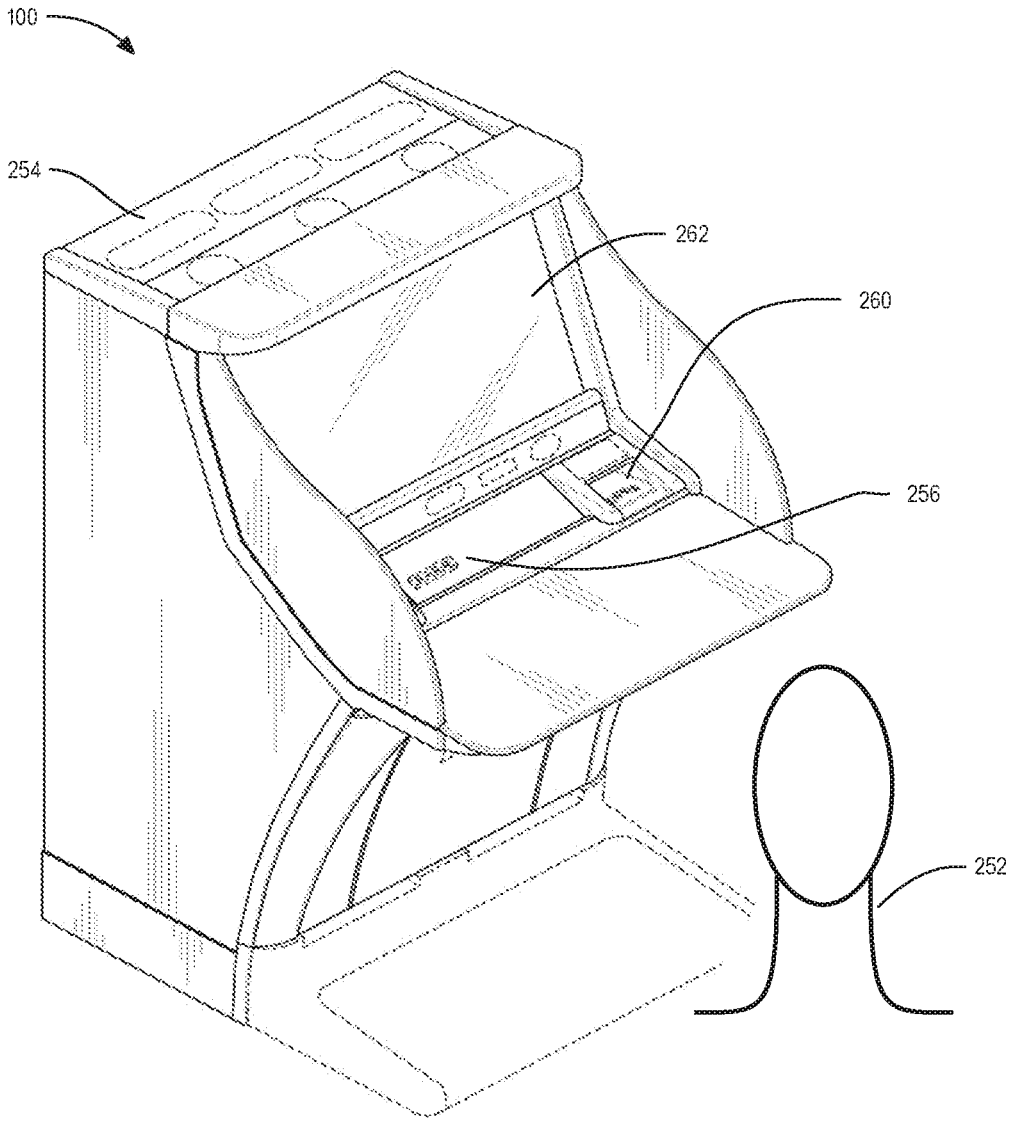
FIGS. 2A and 2B illustrate gaming devices suitable for use with feature described herein, according to some embodiments.

Referring now to FIG. 2A, an example of a gaming device 100 for providing gaming content, video content or other content to a user 252 is illustrated. In this example, gaming device 100 is a sports betting terminal, which may be located in a casino environment, or other suitable location. In other examples, the gaming device 100 may be an electronic gaming machine (EGM), or may include functionality thereof, or other functionality, as desired.

In this example, the gaming device 100 includes a housing 254, a display device 100, and a plurality of input devices 256, such as a touchscreen, keypad, buttons, etc., for receiving user input for playing the wagering game and otherwise interacting with the gaming device 100. In some embodiments, a display device 262 may include a touchscreen interface for receiving user input as well. The display device 262 may also be a single display device or may include multiple display devices, such as a first display device for displaying video content and a second display device for displaying gaming and wagering information for example. In this example, the gaming device 100 includes an acceptor/dispenser 260, for receiving items such as a wagering ticket, currency (i.e., bills and/or coins), tokens, credit or debit cards, or other physical items associated with monetary or other value, and/or for dispensing items, such as physical items having monetary or other value (e.g., awards or prizes), receipts, or other items. It should also be understood that in some embodiments, the gaming device 100 may include an acceptor and/or a dispenser as separate components.

Figure 2B:
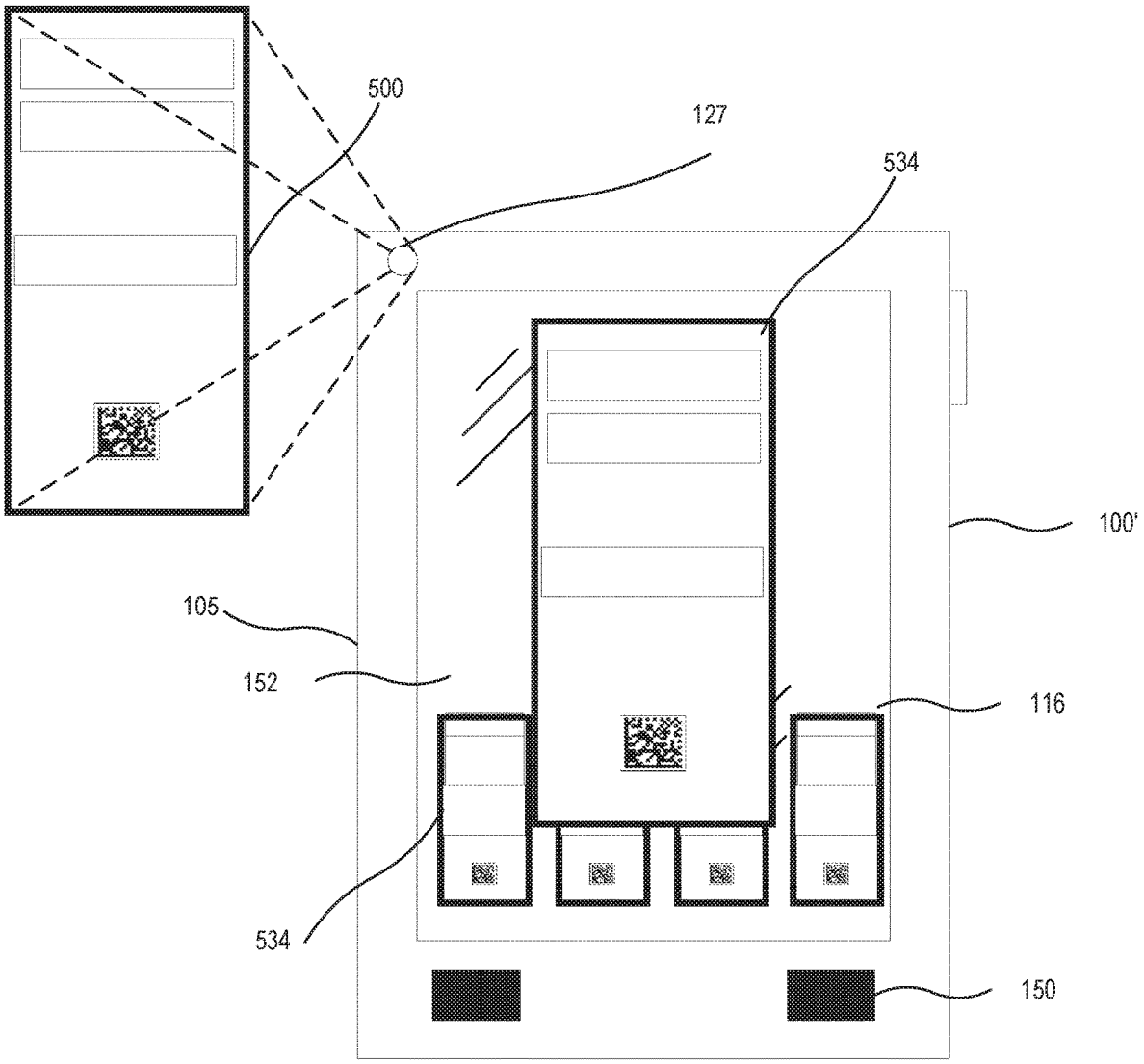

In another embodiment, FIG. 2B illustrates a mobile gaming device 100' having features for scanning, storing and/or modifying gaming ticket images. The mobile gaming device 100' may be implemented as a handheld device including a compact housing 105 on which is mounted a touchscreen display device 116 including a digitizer 152. Cameras 127 may be provided in a front face and/or rear face of the housing 105 for capturing images 534 of a physical gaming ticket 500 (described in greater detail with respect to FIGS. 5A-5D below). The housing 105 may include one or more speakers 150. In the mobile gaming device 100', various input buttons described above may be implemented as soft buttons on the touchscreen display device 116 and/or other input device.

As mobile gaming applications, and particularly mobile sports gaming applications, increase in popularity, compliance with existing gaming regulations, many of which were originally implemented with land-based gaming applications in mind, presents additional challenges. For example, many mobile gaming devices 100' lack a dedicated acceptor or dispenser. Instead, in some examples, the cameras 127, or other image capture devices, may capture images 534 of physical gaming tickets 500 for subsequent storage, alteration, display, or printing, as discussed in connection with other embodiments described herein.

As shown in FIG. 2B, one advantage of using a mobile gaming device 100' to capture and/or access images 534 of gaming tickets 500 is providing a user the ability to view sports wagers and other wagers in a mobile computing context, as well as the ability to transfer the images 534 to other devices, such as a personal computer or other user-controlled device for subsequent viewing, or a server and/or database for storage for example.

Figure 3:
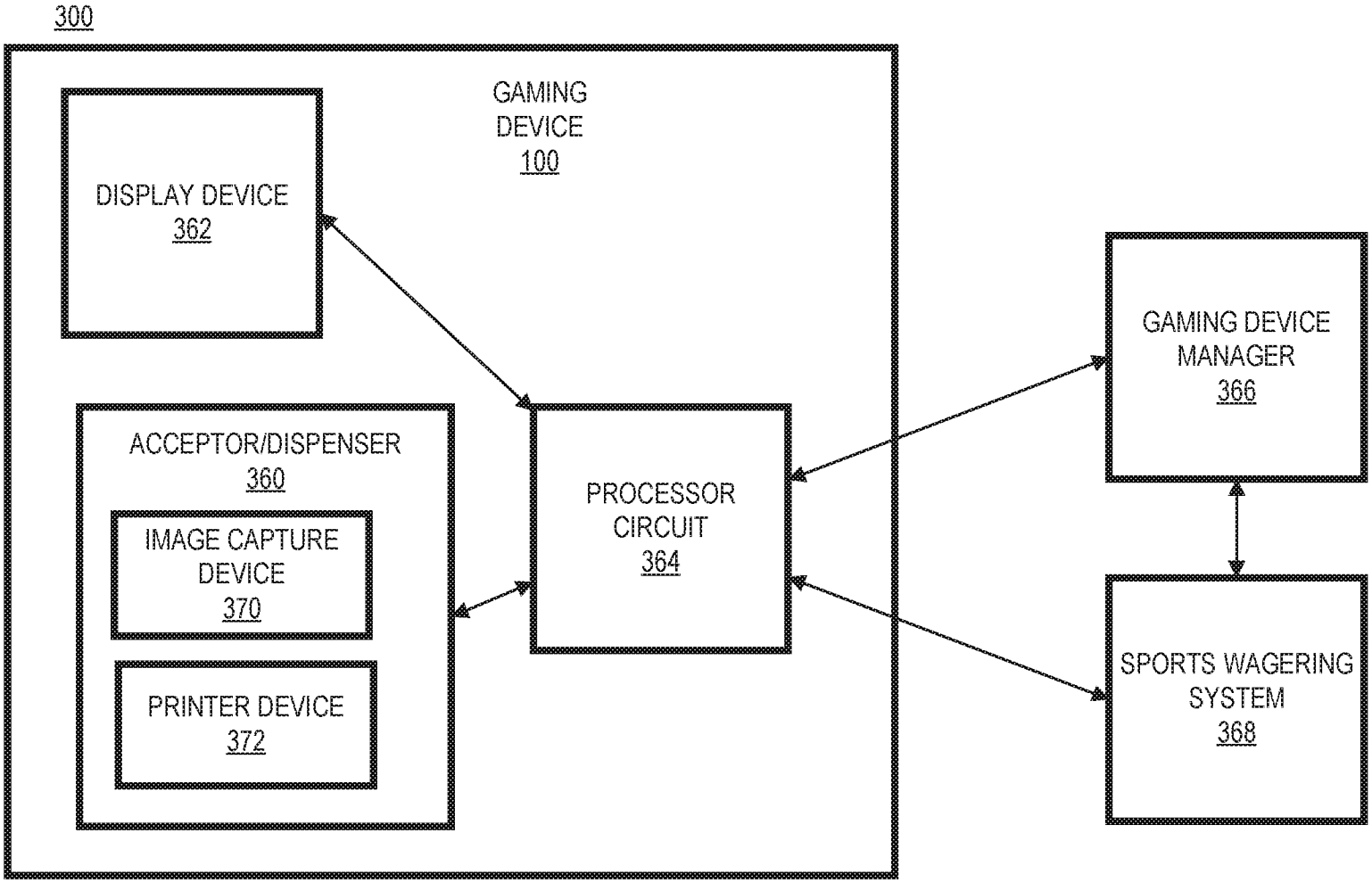
FIG. 3 illustrates a schematic block diagram of a network configuration for components of a gaming device communicating with a gaming device manager and sports wagering system, according to an embodiment.

These and other components may be used to facilitate redeeming wagering tickets, such as sports wagering tickets. In this regard, FIG. 3 illustrates a schematic block diagram of a system 300 employing a network configuration for components of a gaming device 100 communicating with a gaming device manager 366 (which may also be referred to herein as a betting terminal manager) and sports wagering system 368, according to an embodiment.

The gaming device 100 includes a processor circuit 364 for controlling components of the gaming device 100 and for communicating with other components of the system 300. The gaming device 100 also includes a display device 362 and an acceptor/dispenser 360 for receiving and dispensing wagering tickets and other printed items. The acceptor/dispenser 360 in this example includes an image capture device 370 for capturing images of the wagering tickets, and a printer device 372 for printing original or altered versions of the wagering tickets, such as printing printed indications on the wagering ticket, including a printed paid indication, a printed amount indication, and/or a printed time indication, as described in greater detail with respect to FIGS. 5A-5D below. In this example, the image capture device 370 includes a ticket scanner for scanning and validating the gaming ticket, and a camera device for capturing the digital image of the ticket. In this example, the image capture device 370 captures a 100 dots-per-inch (dpi) bitmap rasterized image of the ticket, which is generally sufficient to capture the text and/or encoded symbols on a typical wagering ticket, but it should be understood that higher or lower dpi resolutions, and/or different image formats may be used as well. The acceptor/dispenser 360 may accept wagering tickets and/or bills and stack them in a secure locked box, e.g., within the gaming device 100. The scanner will provide the terminal with the 100-dpi image of both the front and back of a sports wagering ticket.

When a wagering ticket is inserted into the acceptor/dispenser 360, the image capture device 370 generates a digital image of the wagering ticket and the processor circuit 364 transmits the digital image to the gaming device manager 366, which may be located locally, i.e., in close proximity to a bank of gaming devices including the gaming device 100. The processor circuit 364 and/or gaming device manager 366 may also, after determining that the wagering ticket indicates a winning sports wager or other wager, communicate with the sports wagering system 368, which may be located remotely, e.g., elsewhere within the casino or offsite, to validate the wagering ticket for an indicated award, e.g., cash or credit. The sports wagering system 368 redeems (e.g., cashes) the wagering ticket and sends a pay amount to the processor circuit 364 so that the gaming device 100 can provide the award to a player of the gaming device 100 that redeemed the wagering ticket, e.g., by dispensing cash at the acceptor/dispenser 360, by crediting a credit meter of the gaming device 100, or by crediting a cashless account associated with the player. The gaming device 100 then stacks the physical ticket. In some embodiments, the image capture process may occur only in response to determining that the wagering ticket indicates a winning wager, so that digital images are only captured for wagering tickets that trigger reporting or other regulatory requirements.

The gaming device manager 366 receives the digital image from the gaming device 100 and digitally alters the digital image to form a digitally altered digital image having additional information, such as a paid indication indicative that the wagering ticket has been redeemed, an amount indication indicative of an amount paid for the wagering ticket, a time indication indicative of a time period associated with redemption of the wagering ticket, a gaming device identifier, etc., as desired. The altered digital image may then be stored at the gaming device manager 366 or elsewhere, displayed on the display device 362, printed by the printer device 372 and dispensed by the acceptor/dispenser 360, etc., as desired. Alternatively, or in addition, the printer device 372 may print indications on the original wagering ticket as part of the stacking process, such as printing a printed paid indication indicative that the wagering ticket has been redeemed, a printed amount indication indicative of the amount paid for the wagering ticket, and/or a printed time indication indicative of the time period associated with redemption of the wagering ticket, as desired.

In some embodiments, if communication between the gaming device 100 and other components of the system is interrupted or unavailable, gaming device 100 may continue to retry the exchange with the gaming device manager 366. The gaming device may suspend operation if more than a predetermined number (e.g., 5) of cashed tickets are queued at the gaming device 100 without a proper exchange to the gaming device manager 366. The system 300 may delete or purge the digital images, altered digital images and/or data after a predetermined amount of time (e.g., 90 days) to comply with regulatory requirements, privacy policies, and/or to conserve storage and/or computing resources, as desired.

The gaming device manager 366 or other component of the system 300 may include an internal or external memory and/or database for storing the digital image, the altered digital image, and/or data associated with the digital image, such as an encoded paid indication indicative that the wagering ticket has been redeemed, an encoded amount indication indicative of the amount paid for the wagering ticket, and/or an encoded time indication indicative of the time period associated with redemption of the wagering ticket, as desired. In some examples, the digital image is altered using the stored data to form the altered digital image only in response to an instruction to view the wagering ticket, which may be received from the player via the gaming device 100 and which may then be displayed on the display device 362 or printed by the printer device 372, for example. By only generating and/or storing the altered digital image upon request, storage and computing requirements for the system 200 may be reduced.

Figure 4:
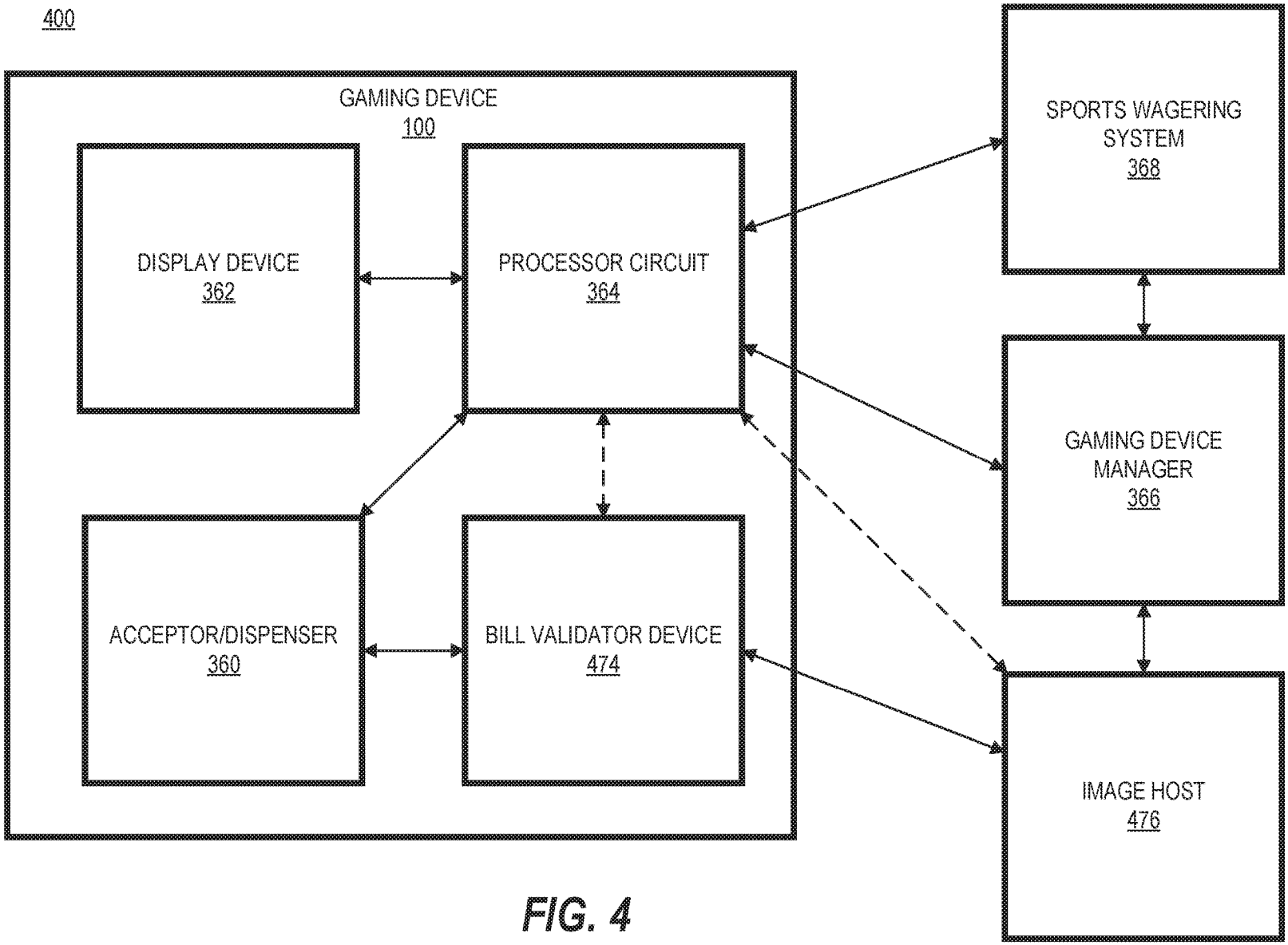
FIG. 4 illustrates a schematic block diagram of a network configuration for components of a gaming device communicating with a gaming device manager, sports wagering system, and image host, according to an embodiment.

In some embodiments, the system may include additional components for managing capture, alteration, and storage of digital ticket images. In this regard, FIG. 4 illustrates a schematic block diagram of a network configuration 400 for components of a gaming device 100 communicating with a gaming device manager 366, sports wagering system 368, and image host 476 (which may also be referred to herein as a scanning host), according to an embodiment.

In this example, the gaming device 100 includes a bill validator device 474 in communication with the acceptor/dispenser 360 and/or processor circuit 364 of the gaming device 100. In this example, the bill validator device 474 is a component of the gaming device 100, but it should be understood that the bill validator device 474 may be a standalone device or a component of another device, as desired. The bill validator device 474 receives the image of the wagering ticket from the acceptor/dispenser 360 and transmits the image to an image host 476. The image host 476 may then digitally alter the digital image and/or store the digital image and associated data. Alternatively, or in addition, the image host 476 may transmit the digital image, altered digital image, and/or associated data to the gaming device manager 366 for processing and/or storage, and/or cause the digital image and/or altered digital image to be displayed on the display device 362.

The bill validator device 474 may be connected to different components of the system 400 using different types of communication links. For example, the bill validator device 474 may communicate with the processor circuit via Universal Serial Bus (USB), while the bill validator device may communicate with the gaming device manager 366 and/or sports wagering system 368 via Ethernet, but it should be understood that any suitable communication links and/or protocols (e.g., USB, Ethernet, serial, etc.) may be used for communication between the different components of the system 400.

Figure 5A:
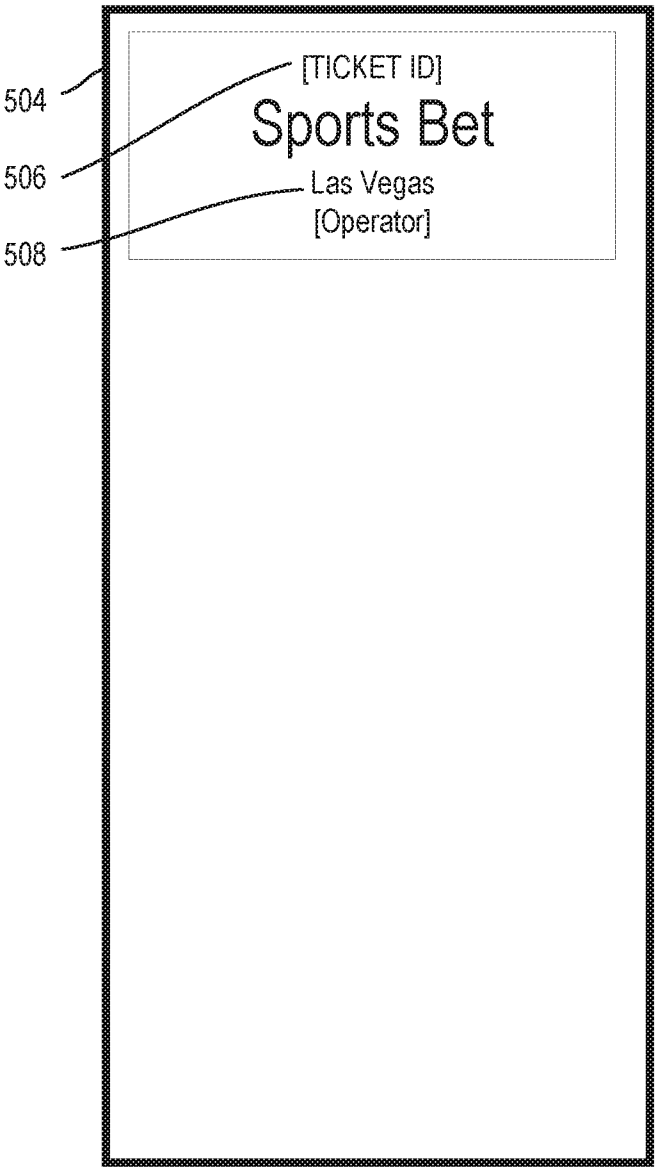
FIGS. 5A-5D are views of a sports wagering ticket and images thereof, according to an embodiment.
Figure 5A:
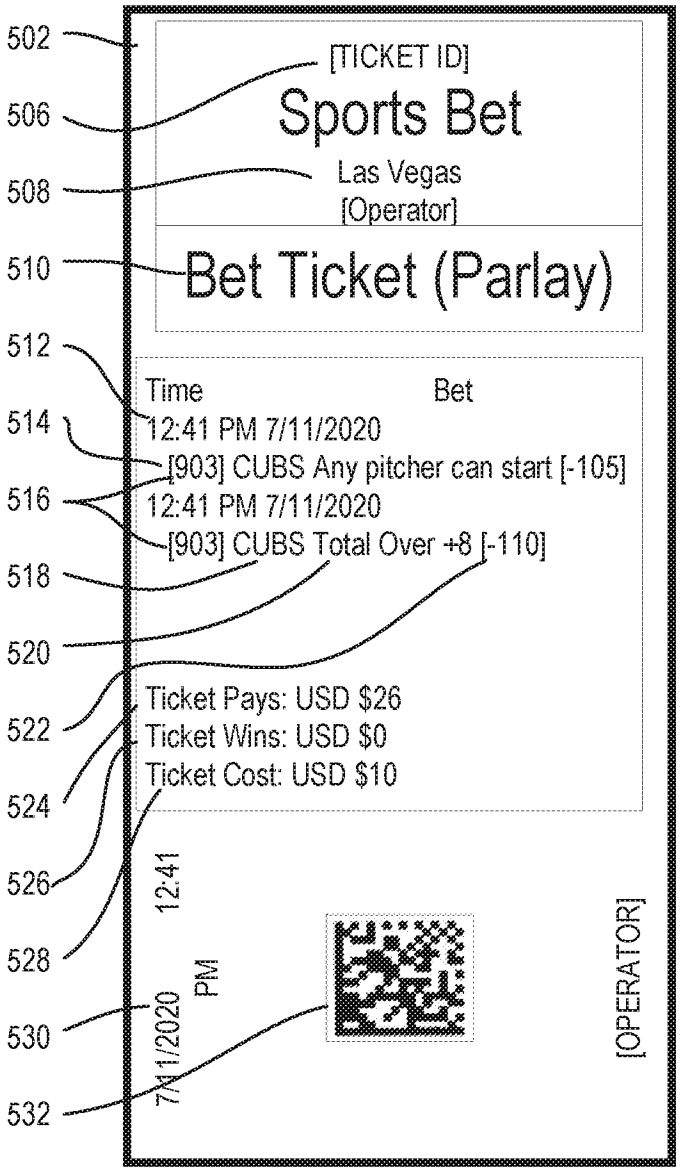

FIGS. 5A-5D are views of a sports wagering ticket 500 and images thereof, which may be captured, altered, stored, and reproduced, according to embodiments disclosed herein. In this regard, FIG. 5A illustrates a wagering ticket 500 having a front side 502 and a reverse side 504. In this example, the front side 502 includes a printed unique ticket identifier 506 that uniquely identifies the ticket 500, operator information 508, and bet information 510. The ticket 500 may include, for each bet, a time stamp 512, a bet description 514, a unique bet identifier 516, and information about the particular bet. This information may include one or more teams 518, an event 520 associated with the bet, and odds 522 associated with the bet. The ticket 500 may also include information identifying a ticket payout 524, win amount 526, and/or a ticket cost 528. The ticket 500 also includes a timestamp 530 indicating when the ticket 500 was generated, and a machine-readable code 532 facilitate redemption of the ticket 500. In this example, the reverse side 504 of the ticket 500 may also include printed information, such as the unique ticket identifier 506, operator information 508, and/or other information, as desired.

Figure 5B:
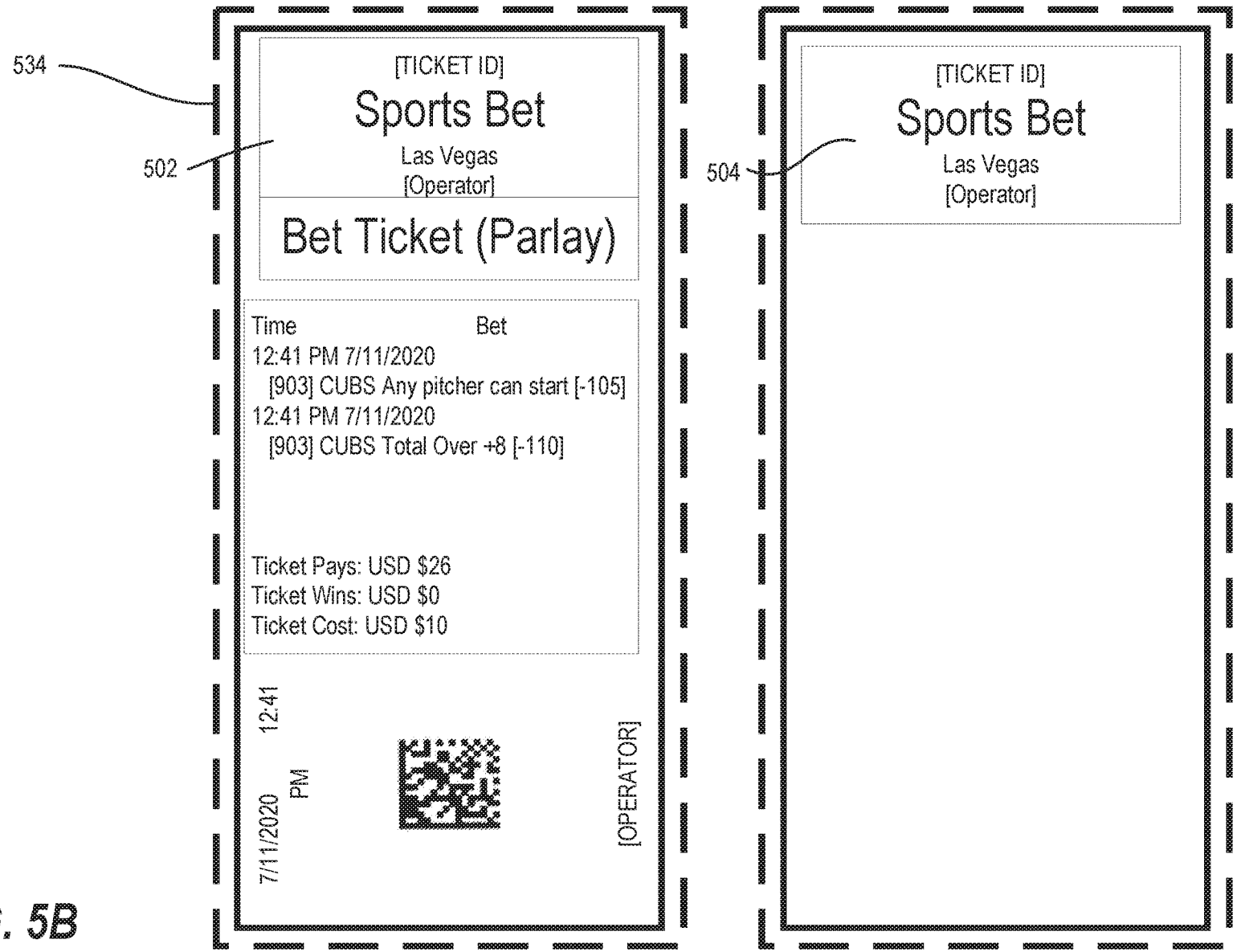
Figure 5C:
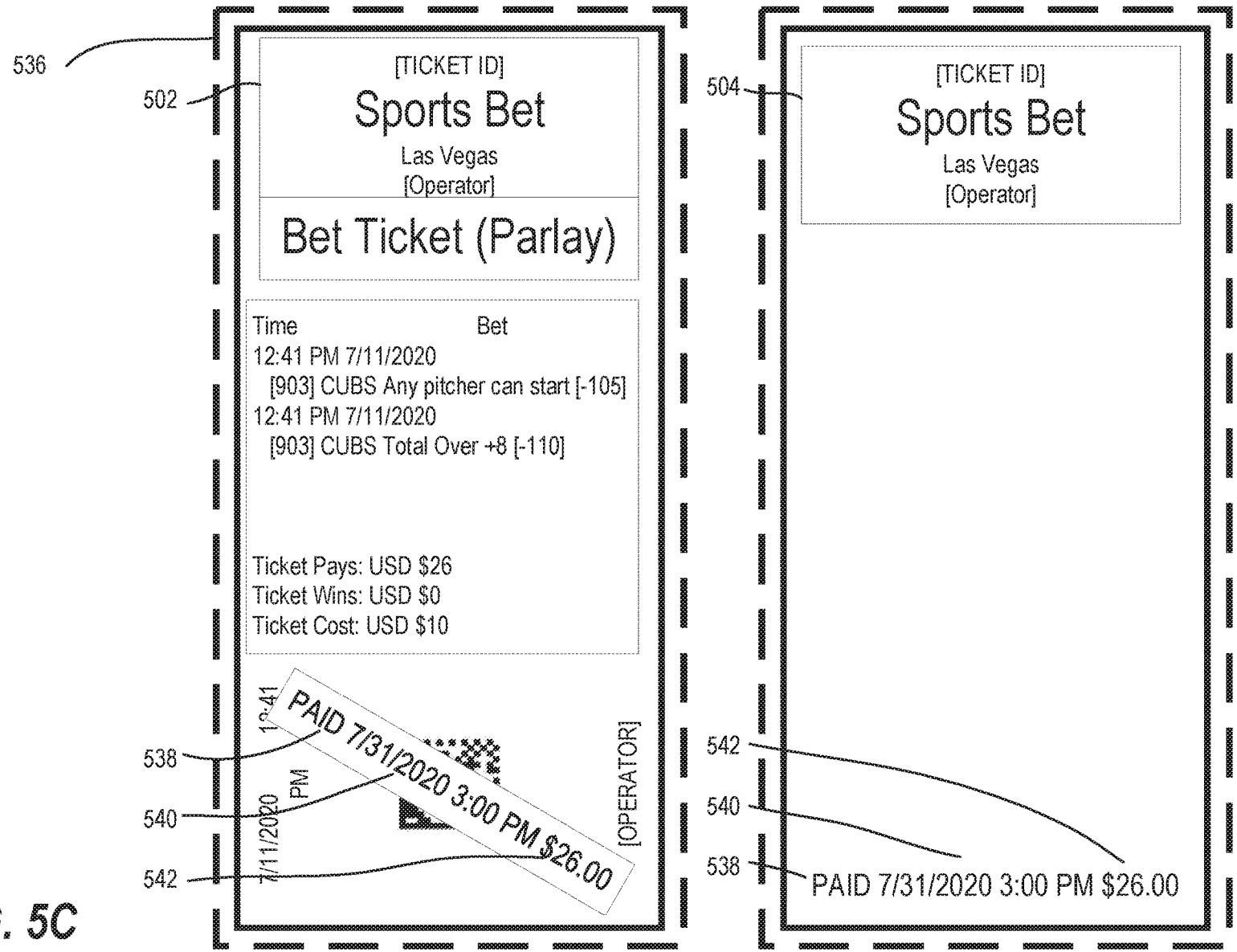
Figure 5D:
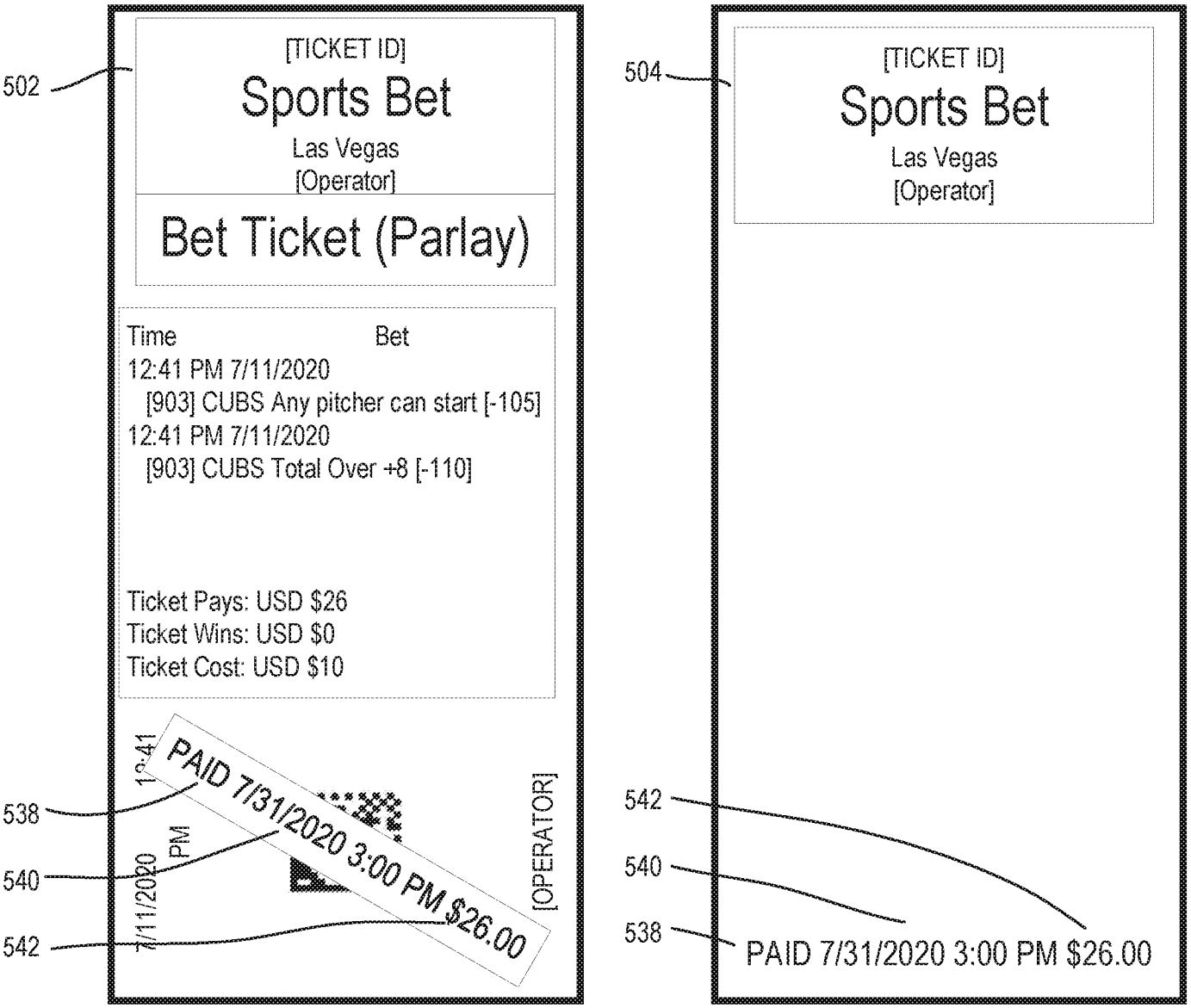

As shown by FIGS. 5B and 5C, digital images 534 of the front side 502 and reverse side 504 of the wagering ticket 500 are captured, e.g., by the image capture device 370 of the acceptor/dispense 360 of the gaming device 100 of FIG. 3, for example., and the digital images 534 are altered to form altered digital images 536 of the wagering ticket 500. As shown by FIG. 5C, graphical indications may be added to the front side 502 and/or reverse side 504 as part of the altered digital image 536, including a paid indication 538, a payment time indication 540, and/or a payment amount indication 542, as desired. The altered digital image may then be stored and/or printed onto a new altered tickets 544, as shown in FIG. 5D. Alternatively, or in addition, the paid indication 538, payment time indication 540, payment amount indication 542 and/or other information may be printed onto the original wagering ticket 500.

Figure 6:
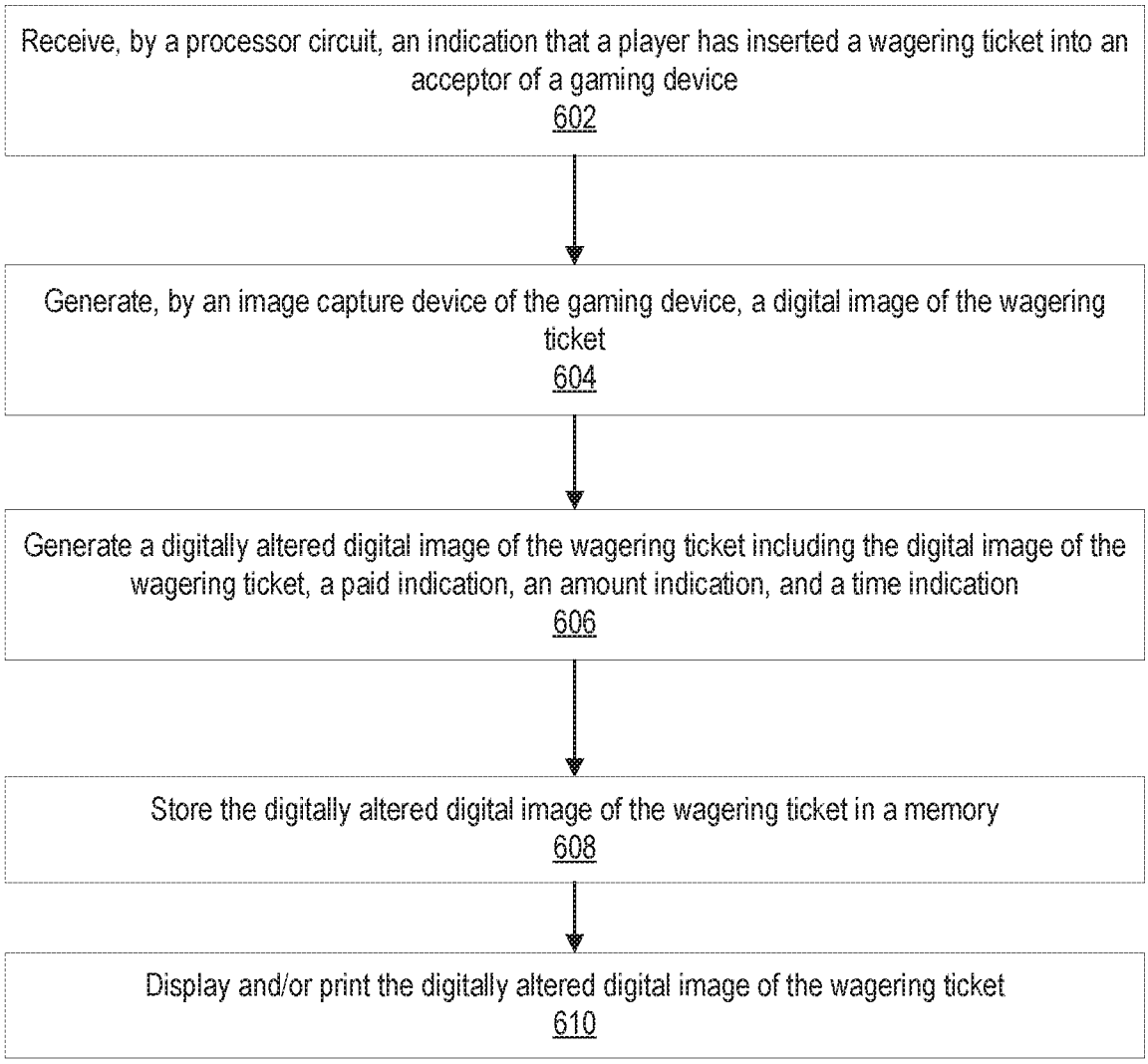
FIG. 6 is a flowchart diagram of operations for generating digitally altered images of wagering tickets, according to an embodiment.

These and other embodiments may be implemented through one or more computer-implemented methods. In this regard, FIG. 6 is a flowchart diagram of operations 600 for generating digitally altered images of wagering tickets, according to an embodiment. In this embodiment, the operations 600 include receiving, by a processor circuit, an indication that a player has inserted a wagering ticket into an acceptor of a gaming device (Block 602). The operations 600 further include generating, by an image capture device of the gaming device, a digital image of the wagering ticket (Block 604). The operations 600 further include generating a digitally altered digital image of the wagering ticket (Block 606). The digitally altered digital image includes the digital image of the wagering ticket, a paid indication indicative that the wagering ticket has been redeemed, an amount indication indicative of an amount paid for the wagering ticket, and a time indication indicative of a time period associated with redemption of the wagering ticket. The operations 600 further include storing the digitally altered digital image of the wagering ticket in a memory (Block 608). The operations 600 may further include displaying and/or printing the digitally altered digital image of the wagering ticket (Block 610).

Figure 7:
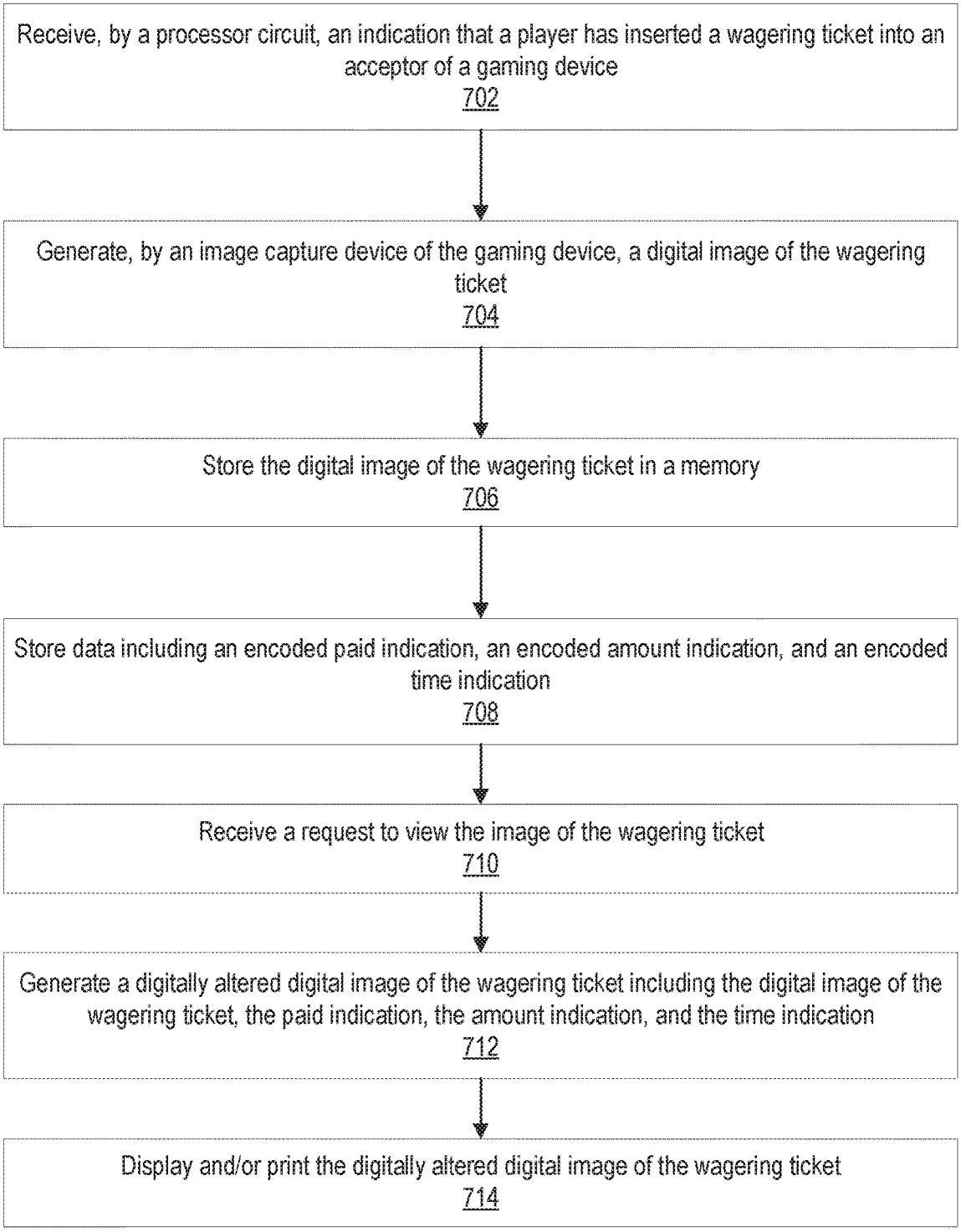
FIG. 7 is a flowchart diagram of operations for generating digitally altered images of wagering tickets, according to another embodiment.

FIG. 7 is a flowchart diagram of operations 700 for generating digitally altered images of wagering tickets, according to another embodiment. In this embodiment, the operations 700 include receiving, by a processor circuit, an indication that a player has inserted a wagering ticket into an acceptor of a gaming device (Block 702). The operations 700 further include generating, by an image capture device of the gaming device, a digital image of the wagering ticket. (Block 704). The operations 700 further include storing the digital image of the wagering ticket (Block 706), and storing data including an encoded paid indication indicative that the wagering ticket has been redeemed, an encoded amount indication indicative of the amount paid for the wagering ticket, and an encoded time indication indicative of the time period associated with the redemption of the wagering ticket (Block 708). The operations 700 further include receiving a request to view the image of the wagering ticket (Block 710). In response to the instruction, the operations 700 further include generating a digitally altered digital image of the wagering ticket that includes the digital image, the paid indication, the amount indication, and the time indication (Block 712). The operations 600 may further include displaying and/or printing the digitally altered digital image of the wagering ticket (Block 714).

Figure 8:
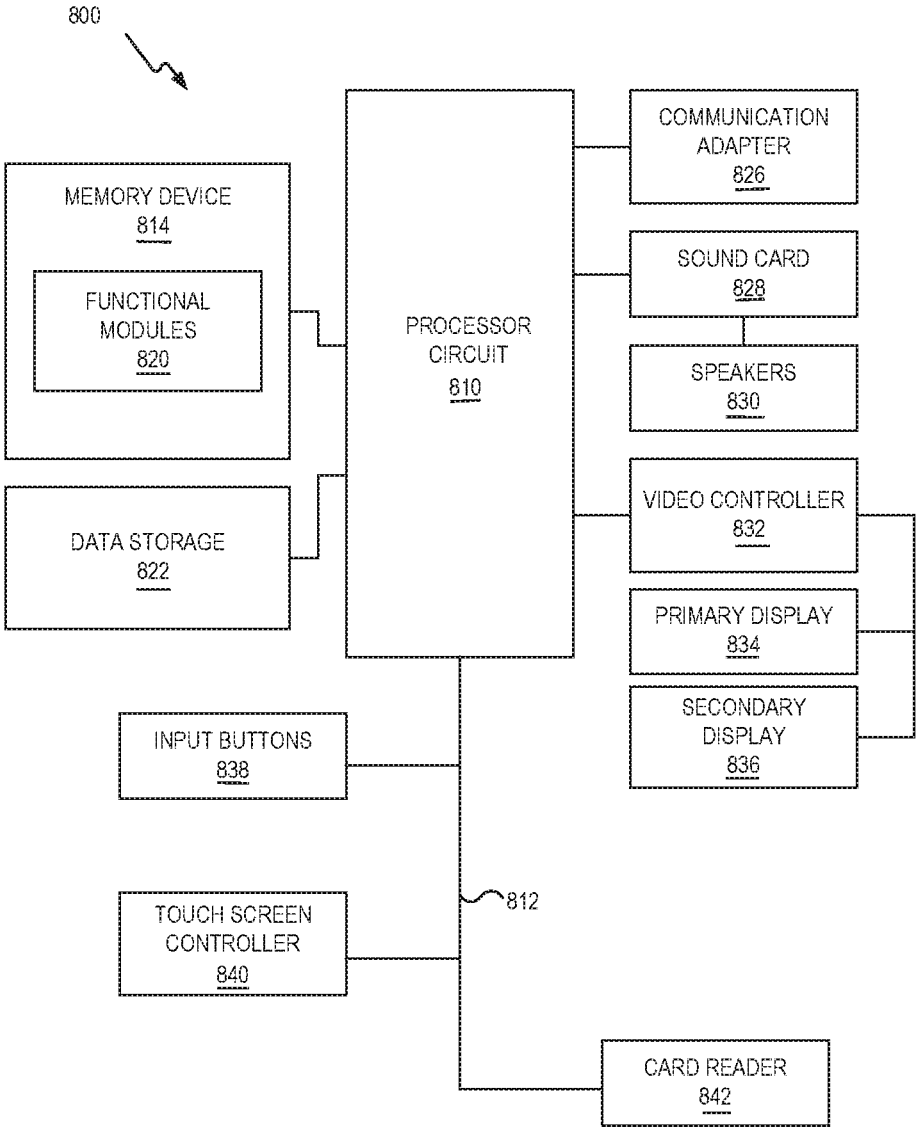
FIG. 8 is a block diagram that illustrates various components of a controller, a gaming device, or other associated computing devices, according to some embodiments.

Referring now to FIG. 8, a block diagram that illustrates various components of a computing device 800, which may embody or be included as part of the gaming device 100 or other components of the systems 10, 300, 400, discussed above with respect to FIGS. 1-4, or other devices or systems, according to some embodiments. As shown in FIG. 8, the computing device 800 may include a processor circuit 810 that controls operations of the computing device 800. Although illustrated as a single processor, multiple special purpose and/or general-purpose processors and/or processor cores may be provided in the computing device 800. For example, the computing device 800 may include one or more of a video processor, a signal processor, a sound processor and/or a communication controller that performs one or more control functions within the computing device 800. The processor circuit 810 may be variously referred to as a "controller," "microcontroller," "microprocessor" or simply a "computer." The processor circuit 810 may further include one or more Application-Specific Integrated Circuits (ASICs).

Various components of the computing device 800 are illustrated in FIG. 8 as being connected to the processor circuit 810. It will be appreciated that the components may be connected to the processor circuit 810 and/or each other through one or more busses 812 including a system bus, a communication bus and controller, such as a USB controller and USB bus, a network interface, or any other suitable type of connection.

The computing device 800 further includes a memory device 814 that stores one or more functional modules 820 for performing the operations described above. Alternatively, or in addition, some of the operations described above may be performed by other devices connected to the network, such as the network 50 of the system 10 of FIG. 1, for example. The computing device 800 may communicate with other devices connected to the network to facilitate performance of some of these operations.

The memory device 814 may store program code and instructions, executable by the processor circuit 810, to control the computing device 800. The memory device 814 may include random access memory (RAM), which can include Non-Volatile RAM (NVRAM), magnetic RAM (ARAM), Ferroelectric RAM (FeRAM) and other forms as commonly understood in the gaming industry. In some embodiments, the memory device 814 may include Read Only Memory (ROM). In some embodiments, the memory device 814 may include flash memory and/or EEPROM (Electrically Erasable Programmable Read Only Memory). Any other suitable magnetic, optical and/or semiconductor memory, such as a data storage 822, may operate in conjunction with the computing device 800 disclosed herein.

The computing device 800 may include a communication adapter 826 that enables the computing device 800 to communicate with remote devices, such as the wireless network, another computing device 800, and/or a wireless access point, over a wired and/or wireless communication network, such as a local area network (LAN), wide area network (WAN), cellular communication network, or other data communication network, e.g., the network 50 of FIG. 1.

The computing device 800 may include one or more internal or external communication ports that enable the processor circuit 810 to communicate with and to operate with internal or external peripheral devices, such as a sound card 828 and speakers 830, video controllers 832, a primary display 834, a secondary display 836, input buttons 838 or other devices such as switches, keyboards, pointer devices, and/or keypads, a touch screen controller 840, a card reader 842, currency acceptors and/or dispensers, cameras, sensors such as motion sensors, mass storage devices, microphones, haptic feedback devices, and/or wireless communication devices. In some embodiments, internal or external peripheral devices may communicate with the processor circuit 810 through a USB hub (not shown) connected to the processor circuit 810. Although illustrated as being integrated with the computing device 800, any of the components therein may be external to the computing device 800 and may be communicatively coupled thereto. Although not illustrated, the computing device 800 may further include a rechargeable and/or replaceable power device and/or power connection to a main power supply, such as a building power supply.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an EEPROM or Flash memory, an appropriate optical fiber with a repeater, a portable Compact Disc Read-Only Memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, Radio Frequency (RF), etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, Visual Basic.NET (VB.NET), Python or the like, conventional procedural programming languages, such as the "C" programming language, Visual Basic, Fortran 2003, Perl, Common Business-Oriented Language (COBOL) 2002, Personal Home Page (PHP), Advanced Business Application Programming (ABAP), dynamic programming languages such as Python, Ruby and Groovy, or other programming languages. The program code may execute entirely on the user's computer, partly on the user's computer, as a standalone software package, partly on the user's computer and partly on a remote computer or entirely on the remote computer or server. In the latter scenario, the remote computer may be connected to the user's computer through any type of network, including a Local Area Network (LAN) or a Wide Area Network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor circuit of a general purpose computer, special purpose computer, or other programmable data processing apparatus to produce a machine, such that the instructions, which execute via the processor circuit of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operations to be performed on the computer, other programmable apparatuses or other devices to produce a computer implemented process such that the instructions which execute on the computer or other programmable apparatus provide processes for implementing the functions/acts specified in the flowchart and/or block diagram block or blocks. The flowchart and block diagrams in the figures illustrate the architecture, functionality, and operation of possible implementations of systems, methods, and computer program products according to various aspects of the present disclosure. In this regard, each block in the flowchart or block diagrams may represent a module, segment, or portion of code, which includes one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be designated as "/". Like reference numbers signify like elements throughout the description of the figures.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

What is claimed is:

1. A system for redeeming sports wagering tickets comprising:

a processor circuit; and a memory coupled to the processor circuit, the memory comprising machine-readable instructions that, when executed by the processor circuit, cause the processor circuit to:

receive an indication that a player has inserted a wagering ticket into an acceptor of a gaming device;

cause an image capture device to capture a digital image of the wagering ticket;

determine that the wagering ticket is indicative of a winning sports wager;

digitally alter the digital image of the wagering ticket to form a digitally altered digital image comprising:

a graphical paid indication indicative that the wagering ticket has been redeemed;

a graphical amount indication indicative of an amount paid for the wagering ticket; and a graphical time indication indicative of a time period associated with redemption of the wagering ticket;

store the digitally altered digital image in a database; and control the gaming device to cause the gaming device to pay the amount paid for the wagering ticket to the player.

2. The system of claim 1, wherein the instructions to digitally alter the digital image further cause the processor circuit to digitally alter the digital image only in response to a determination that the wagering ticket comprises the indication of the winning sports wager.

3. The system of claim 1, wherein the machine-readable instructions further cause the processor circuit to:

in response to a determination that the wagering ticket comprises the indication of the winning sports wager, provide an award associated with the winning sports wager to the player.

4. The system of claim 1, wherein the machine-readable instructions further cause the processor circuit to:

cause a printer device of the gaming device to print a plurality of printed indications on the wagering ticket, the plurality of printed indications comprising:

a printed paid indication indicative that the wagering ticket has been redeemed;

a printed amount indication indicative of the amount paid for the wagering ticket; and a printed time indication indicative of the time period associated with the redemption of the wagering ticket.

5. The system of claim 1, wherein the machine-readable instructions further cause the processor circuit to:

store data associated with the digital image in the database, the data comprising:

an encoded paid indication indicative that the wagering ticket has been redeemed;

an encoded amount indication indicative of the amount paid for the wagering ticket; and an encoded time indication indicative of the time period associated with the redemption of the wagering ticket.

6. The system of claim 5, wherein the machine-readable instructions further cause the processor circuit to:

receive an instruction to view the wagering ticket, wherein the instructions to digitally alter the digital image further cause the processor circuit to digitally alter the digital image based on the data only in response to the instruction to view the wagering ticket.

7. The system of claim 6, wherein the machine-readable instructions further cause the processor circuit to:

in response to receiving the instruction to view the wagering ticket, cause a display device to display the digitally altered digital image.

8. The system of claim 6, wherein the machine-readable instructions further cause the processor circuit to:

in response to receiving the instruction to view the wagering ticket, cause a printer device to print the digitally altered digital image.

9. The system of claim 1, wherein the machine-readable instructions further cause the processor circuit to:

delete the digitally altered digital image from the database after a predetermined amount of time.

10. The system of claim 1, wherein the digital image comprises a first image of a front side of the wagering ticket and a second image of a reverse side of the wagering ticket, and wherein the digitally altered digital image further comprises:

a first digitally altered digital image comprising the paid indication, the amount indication, and the time indication; and a second digitally altered digital image comprising the paid indication, the amount indication, and the time indication.

11. The system of claim 1, wherein the instructions that cause the processor circuit to cause the gaming device to pay the amount paid for the wagering ticket to the player further cause the processor circuit to:

cause a dispenser of the gaming device to dispense the amount paid as cash.

12. The system of claim 1, wherein the instructions that cause the processor circuit to cause the gaming device to pay the amount paid for the wagering ticket to the player further cause the processor circuit to:

credit the amount paid to a cashless account associated with the player.

13. A method comprising:

receiving, by a processor circuit, an indication that a player has inserted a physical wagering ticket into an acceptor of a gaming device;

capturing, by an image capture device of the gaming device, a digital image of the physical wagering ticket; and generating a digitally altered digital image of the physical wagering ticket comprising:

the digital image of the physical wagering ticket;

a graphical paid indication indicative that the physical wagering ticket has been redeemed;

a graphical amount indication indicative of an amount paid for the physical wagering ticket; and a graphical time indication indicative of a time period associated with redemption of the physical wagering ticket; and printing a plurality of printed indications on the physical wagering ticket, the plurality of printed indications comprising:

a printed paid indication indicative that the physical wagering ticket has been redeemed;

a printed amount indication indicative of the amount paid for the physical wagering ticket; and a printed time indication indicative of the time period associated with the redemption of the physical wagering ticket.

14. The method of claim 13, wherein generating the digitally altered digital image of the physical wagering ticket further comprises:

determining that the physical wagering ticket comprises an indication of a winning sports wager; and generating the digitally altered digital image of the physical wagering ticket only in response to determining that the physical wagering ticket comprises the indication of the winning sports wager.

15. The method of claim 13, the method further comprising:

storing the digital image in a database; and storing data associated with the digital image in the database, the data comprising:

an encoded paid indication indicative that the physical wagering ticket has been redeemed;

an encoded amount indication indicative of the amount paid for the physical wagering ticket; and an encoded time indication indicative of the time period associated with the redemption of the physical wagering ticket, wherein the digitally altered digital image of the physical wagering ticket is based on the data.

16. The method of claim 15, wherein generating the digitally altered digital image of the physical wagering ticket further comprises:

receiving an instruction to view the physical wagering ticket; and generating the digitally altered digital image of the physical wagering ticket only in response to the instruction to view the physical wagering ticket.

17. A system for redeeming sports wagering tickets comprising:

an image host device comprising an acceptor, the acceptor comprising a ticket scanning device and an image capture device;

a gaming device manager device in communication with the image host device;

a sports wagering system device in communication with the gaming device manager device;

a first communication link between the gaming device manager device and the image host device;

a second communication link between the sports wagering system device and the gaming device manager device;

a processor circuit; and a memory coupled to the processor circuit, the memory comprising machine-readable instructions that, when executed by the processor circuit, cause the processor circuit to:

receive an indication that a player has inserted a wagering ticket into the acceptor of a gaming device;

cause the image capture device to capture a digital image of the wagering ticket;

cause the image host device to receive the digital image of the wagering ticket from the image capture device via the first communication link;

cause the image host device transmit the digital image to the gaming device manager device via the first communication link;

cause the gaming device manager device to digitally alter the digital image of the wagering ticket to form a digitally altered digital image comprising:

a paid indication indicative that the wagering ticket has been redeemed;

an amount indication indicative of an amount paid for the wagering ticket; and a time indication indicative of a time period associated with redemption of the wagering ticket; and store the digitally altered digital image in a database; and cause the gaming device to pay the amount paid for the wagering ticket to the player.

18. The system of claim 17, wherein the machine-readable instructions that cause the gaming device manager device to digitally alter the digital image further cause the processor circuit to:

determine that the wagering ticket comprises an indication of a winning sports wager; and cause the gaming device manager device to digitally alter the digital image to form the digitally altered digital image only in response to a determination that the wagering ticket comprises the indication of the winning sports wager.

19. The system of claim 17, wherein the machine-readable instructions further cause the processor circuit to:

cause the gaming device manager device to store the digital image in a database; and cause the gaming device manager device to store data associated with the digital image in the database, the data comprising:

an encoded paid indication indicative that the wagering ticket has been redeemed;

an encoded amount indication indicative of the amount paid for the wagering ticket; and an encoded time indication indicative of the time period associated with the redemption of the wagering ticket, wherein the machine-readable instructions that cause the gaming device manage device to digitally alter the digital image further cause the processor circuit to:

receive an instruction to view the wagering ticket; and cause the gaming device manage device to digitally alter the digital image based on the data to form the digitally altered digital image only in response to the instruction to view the wagering ticket.

* * * * *